US005819393A

United States Patent [19]

Bockart et al.

[11] Patent Number: 5,819,393

[45] Date of Patent: Oct. 13, 1998

[54] ABUTTING DEVICE

[76] Inventors: Rene Bockart, 3735 Hawthorne, Troy, Mich. 48083; Michael Raymond Smith, 4620 Woodhull, Clarkston, Mich. 48346

[21] Appl. No.: 690,638

[22] Filed: Jul. 30, 1996

[51] Int. Cl.[6] ..... B23P 11/00; B23P 19/04

[52] U.S. Cl. ..... 29/525; 29/254; 81/463

[58] Field of Search ..... 29/254, 275, 525; 81/463; 173/90, 128

[56] References Cited

U.S. PATENT DOCUMENTS

| | | | |
|---|---|---|---|
| 876,693 | 1/1908 | Coldwell . | |
| 1,873,294 | 8/1932 | Cosgrove . | |
| 2,421,324 | 5/1947 | Graham . | |
| 3,568,657 | 3/1971 | Gue . | |
| 3,596,342 | 8/1971 | Willfurth . | |
| 3,939,546 | 2/1976 | Hernandez . | |
| 3,940,170 | 2/1976 | Williams | 81/463 X |
| 3,949,816 | 4/1976 | Harvath . | |
| 4,423,721 | 1/1984 | Otte et al. . | |
| 5,012,567 | 5/1991 | Hill | 29/275 |
| 5,516,170 | 5/1996 | Kruskamp . | |

*Primary Examiner*—S. Thomas Hughes
*Attorney, Agent, or Firm*—Lott & Friedland, PA

[57] ABSTRACT

This invention provides for a method and apparatus for abutting adjacent articles. Specifically this method and apparatus is particularly suited for abutting adjacent articles, such as wood flooring panels, which are immediately adjacent to obstructions which prohibit the use of previous abutting devices. This invention can abut wood flooring panels which are in close proximity to obstructions by providing: a horizontal base member with a front side, a back side, a top side and a bottom side which sets on the wood flooring to be abutted; a lipped member rigidly and perpendicularly communicated to said bottom side and said front side of said horizontal base member which attaches to a floor board that is adjacent to an obstruction; a first vertical support member with an interior side and an exterior side rigidly and perpendicularly communicated to said front side and said top side of said horizontal base member with a cavity on said interior; a second vertical support member with an interior side and an exterior side rigidly communicated to said back side and said top side of said horizontal base member with a cylindrical cavity on said interior; a cylindrical horizontal rod member with a front side and a back side wherein said front side is snugly fitted in said cylindrical cavity in said first vertical support member and said back side is snugly fitted into said cylindrical cavity in said second vertical support member; and a momentum building member slidably attached to said horizontal rod member between said first vertical support member and said second vertical support member such that there is sufficient distance between said first vertical support member and said second vertical support member to allow for said momentum building member to slide and build momentum when traversing from said first vertical support member to said second vertical support member and impacting thereon.

12 Claims, 3 Drawing Sheets

ABUTTING DEVICE

FIELD OF THE INVENTION

This invention relates generally to an abutting device, and more specifically to a device that abuts wood flooring panels which are in close proximity to an obstruction, which heretofore has not been possible due to the difficulty of exerting a force transverse to the length of the board immediately adjacent the obstruction. The present invention remedies this difficulty by providing a method and apparatus for exerting a force transverse to the length of the wood flooring panel which is immediately adjacent an obstruction, thereby forcing said wood flooring panel snugly against an adjacent wood flooring panel. This is accomplished by providing a means for creating linear momentum which requires minimal distance between said wood flooring panel and the obstructive object and transmitting said linear momentum to the wood flooring panel, thereby forcing said wood flooring panel snugly against an adjacent wood flooring panel.

BACKGROUND OF THE INVENTION

There are many ways in which to force objects which are adjacent to one another snugly together. The simplest way, of course, is to simply provide a force transverse to the length of the two objects by using a device such as a hammer or rubber mallet. This is accomplished by building up linear momentum in the hammer and then directly imparting that momentum into the side of the object by direct contact. Thus the momentum is transmitted to the object, which is then forced via the transverse momentum snugly against the adjacent object. This simple methodology fails, however, when there is insufficient space to build momentum in such a way that it can be imparted to the object in a direction that will force the object against the adjacent object.

This realization is very important in the flooring industry and particularly in the wood flooring industry. Wood floors are installed by placing individual wood flooring boards on the surface on which they are to be installed and then providing a force to the side of one board to snugly force it against the adjacent board so that there are no gaps or space between the individual boards. This is a very simple process so long as there is sufficient space on the side of the board which is to be forced so one can generate a linear momentum. Imparting a force becomes significantly more difficult as this area to create a force diminishes. For example, when installing the last wood flooring board, usually a wall is immediately adjacent. It is therefore impossible to generate momentum with a hammer or rubber mallet as you cannot swing the hammer in such a way as to impart a force in a direction that would force a wood flooring board against an adjacent wood flooring board.

There have been attempts to assist in imparting linear momentum to articles to force them against adjacent articles. U.S. Pat. No. 3,939,546 to Hernandez describes a tool for setting jointed flooring boards, particularly of the tongue-and-groove type, having a bracket of L-Shaped cross section to which a length of construction lumber is removably attached by screws. A long handle is rigidly and adjustably attached to the bracket and the user grips the handle to slide the length of the lumber back and forth across the floor joists to drive a flooring panel into engagement with a mating floor panel. This tool basically comprises a bracket 16 to which is mounted a board 18, and a long tubular handle 20 mounted to the bracket such that a workman can stand at the panel junction holding the handle. The flanges are L-shaped at their trailing ends and double as reinforcing ribs for the bracket, and a second pair of reinforcing ribs 32 is provided near the outer ends of the bracket. A pair of braces 34 are rigidly secured to the handle and pivotally connected to the ribs 32 to permit adjustment of the handle. Although this device would assist in imparting linear momentum to an object, it would not remedy the difficulty of imparting said linear momentum when the object it is to be imparted onto is adjacent an obstruction.

Further, U.S. Pat. No. 876,693 to Coldwell describes a device for setting up tongue and groove flooring and the like. The device comprises a handle bar or lever 1, into the lower end of which is driven a shank 2 of a metallic foot or fulcrum member having its outer end provided with a chisel edge 4 designed to bite into a floor beam or the like. The foot or fulcrum member is provided with an intermediate enlargement 5 which is flat and is straddled by the forked rear end of a link 6, which is broadened out at its free end to form a shoe 7 having a transverse shoulder 8 depending therefrom in rear of the front edge of the shoe. The portion of the shoe which projects in front of the shoulder 8 is provided with a pair of perforations 10 for the reception of suitable set screws 11 designed to hold in place a grooved liner element 12, which is preferably a short piece of a grooved section of flooring. As with the present invention the '693 patent provides a means for forcing adjacent floor boards together, but as with the '546 patent a large space is required between an obstruction and the floor board on which the force is exerted. Unless sufficient space is provided the lever 1 cannot operate thereby forcing the adjacent floor boards together.

Previous inventions have also utilized a momentum building member which is slidably connected to a rod, which imparts momentum by impacting a component on the device which transmits said momentum to a desired location. U.S. Pat. No. 4,423,721 to Otte et al. describes a metallic device for the insertion and extraction of medullary nails having a guide tube 1 which is comprised of two successive longitudinal sections 2, 3. Striking elements 7, 11 are disposed on opposite ends of the tube and a displaceable strike busing 6 is located on the tube between striking elements. At the end of guide tube 1, farthest from the nail, the tube is provided with a longitudinal section 4 recessed to a smaller diameter and on which is fitted a two-piece sleeve 8 which has an outside diameter greater than the outside diameter of the guide tube 1. A clamping sleeve 9 is provided with a collar directed toward the strike bushing applying sleeve 8 which is against the guide tube 1 during the driving in or insertions of a medullar nail.

Additionally, U.S. Pat. No. 3,568,657 to Gue describes an elongated rock-breaking bar with a chisel point 20 at one end and at the opposite end a chisel edge 18. In between these ends are a pair of longitudinally spaced collars 24, 22 between which a hammer member 26 is mounted slidably on the bar. The invention provides for two embodiments: one with the hammer member 26 in two pieces 2 for insertion on the bar 10; the other with the bar 10 in two pieces 3 for insertion of the hammer member. The slideability of the hammer member 26 on the bar 10 with an impact with one of the collars 24 or 22 provides for the momentum for rock-breaking. Although the '721 and the '657 patents disclose the momentum transfer discussed supra, due to there configuration they would not be able to impart the linear momentum to a wood flooring board in such a way that the momentum would force the wood flooring board against an adjacent wood flooring board, unless there was a great deal of space between said floor board and an obstruction.

Consequently there is a great need in the wood flooring industry, and any industry that requires two adjacent articles which are bound on one side by an obstruction to be snugly forced together, for a device that can impart a force transverse to the length of the wood flooring and can do so in minimal space. This invention precisely fulfills that need.

SUMMARY OF THE INVENTION

This invention provides for a method and apparatus for abutting adjacent articles. Specifically this method and apparatus is particularly suited for abutting adjacent articles, such as wood flooring panels, which are immediately adjacent to obstructions which prohibit the use of previous abutting devices. This invention can abut wood flooring panels which are in close proximity to obstructions by providing: a horizontal base member with a front side, a back side, a top side and a bottom side which sets on the wood flooring to be abutted; a lipped member rigidly and perpendicularly communicated to said bottom side and said front side of said horizontal base member which attaches to a floor board that is adjacent to an obstruction; a first vertical support member with an interior side and an exterior side rigidly and perpendicularly communicated to said front side and said top side of said horizontal base member with a cavity on said interior; a second vertical support member with an interior side and an exterior side rigidly communicated to said back side and said top side of said horizontal base member with a cylindrical cavity on said interior; a cylindrical horizontal rod member with a front side and a back side wherein said front side is snugly fitted in said cylindrical cavity in said first vertical support member and said back side is snugly fitted into said cylindrical cavity in said second vertical support member; and a momentum building member slidably attached to said horizontal rod member between said first vertical support member and said second vertical support member such that there is sufficient distance between said first vertical support member and said second vertical support member to allow for said momentum building member to slide and build momentum when traversing from said first vertical support member to said second vertical support member and impacting thereon.

DESCRIPTION OF THE PREFERRED EMBODIMENT

Figure 1A:
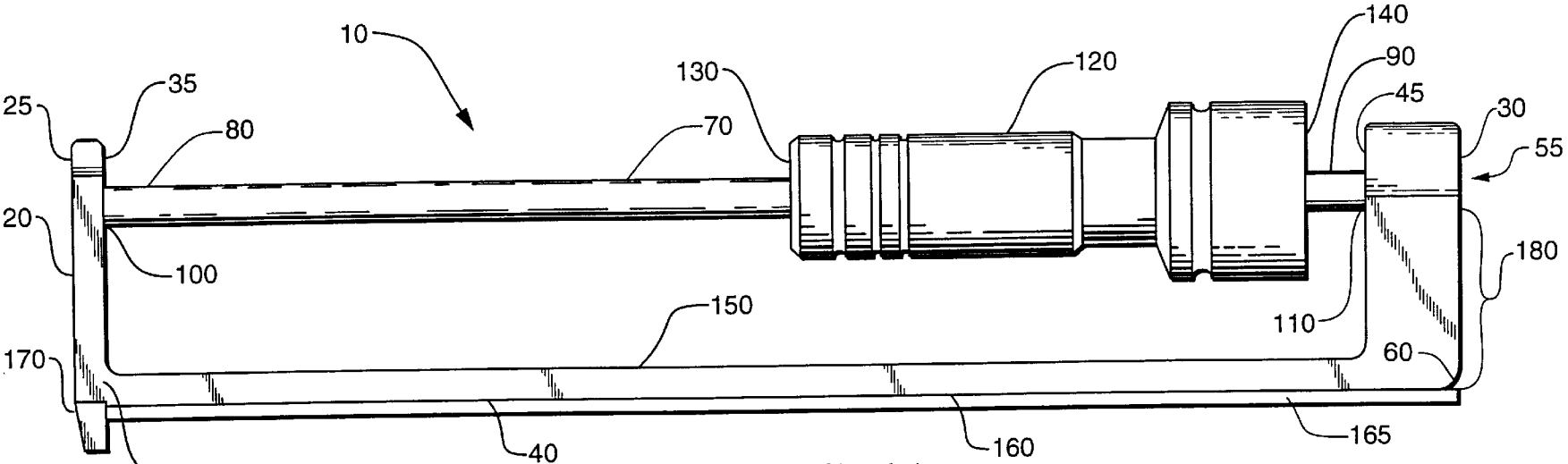
FIG. 1 details all components of the preferred embodiment of the present invention

Shown generally as 10 in FIG. 1A the abutting device of the present invention has a horizontal base member 40, with a front side 50, a back side 60, a top side 150 and a bottom side 160, with a non-skid material 165, attached thereto by means of an adhesive, which sets on the wood flooring to be abutted. A lipped member 170 is rigidly and perpendicularly communicated to said bottom side 160 and said front side 50 of said horizontal base member 40 which attaches to a floor board that is adjacent to an obstruction. A first vertical support member 20 with an interior side 35 and an exterior side 25 rigidly and perpendicularly communicated to said front side 50 and said top side 150 of said horizontal base member 40 with a cylindrical cavity 100 on said interior 35;

A second vertical support member 30 with an interior side 45 and an exterior side 55 rigidly communicated to said back side 60 and said top side 150 of said horizontal base member 40 with a cylindrical cavity 110 on said interior 45. A cylindrical horizontal rod member 70 with a front side 80 and a back side 90 wherein said front side 80 is snugly fitted in said cylindrical cavity 100 in said first vertical support member 20 and said back side 90 is snugly fitted into said cylindrical cavity 110 in said second vertical support member 30.

A momentum building member 120 with a front side 130 and a back side 140 is slidably attached to said horizontal rod member 70 between said first vertical support member 20 and said second vertical support member 30 such that there is sufficient distance between said 30 first vertical support member 20 and said second vertical support member 30 to allow for said momentum building member 120 to slide and build momentum when traversing from said first vertical support, wherein said front side 130 of said momentum building member 120 is adjacent vertical support member 20, to said second vertical support member 30, wherein said back side 140 of said momentum building member 120 impacts thereon. The distance between the horizontal rod 70 and the horizontal base member 40 created by said first vertical support member 20 and said second vertical support member 30 is preferably at least three inches shown as 180. This distance provides for varying sizes of momentum building members 120 as well as allowing for a user to grip the momentum building member even if wearing gloves.

Figure 1C:
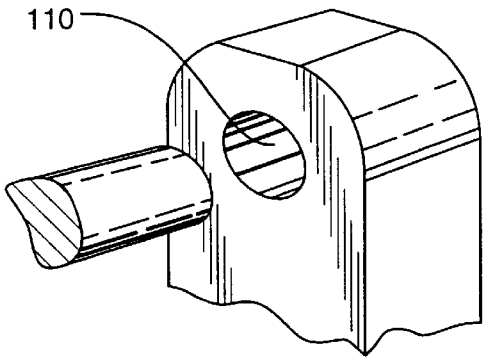
Figure 1B:
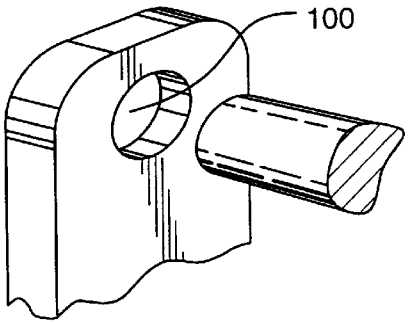

FIG. 1B enlarges the connecting point of said front side 80 of said horizontal rod 70 and said first vertical support member 20 into said cylindrical cavity 100. FIG. 1C enlarges the connecting point of said back side 90 of said horizontal rod 70 and said second vertical support member 30 into said cylindrical cavity 110. It is appreciated that there is many possible ways to combine said horizontal rod 70 and said first and said second vertical support members with the illustrations herein for exemplification and demonstration only.

Figure 2:
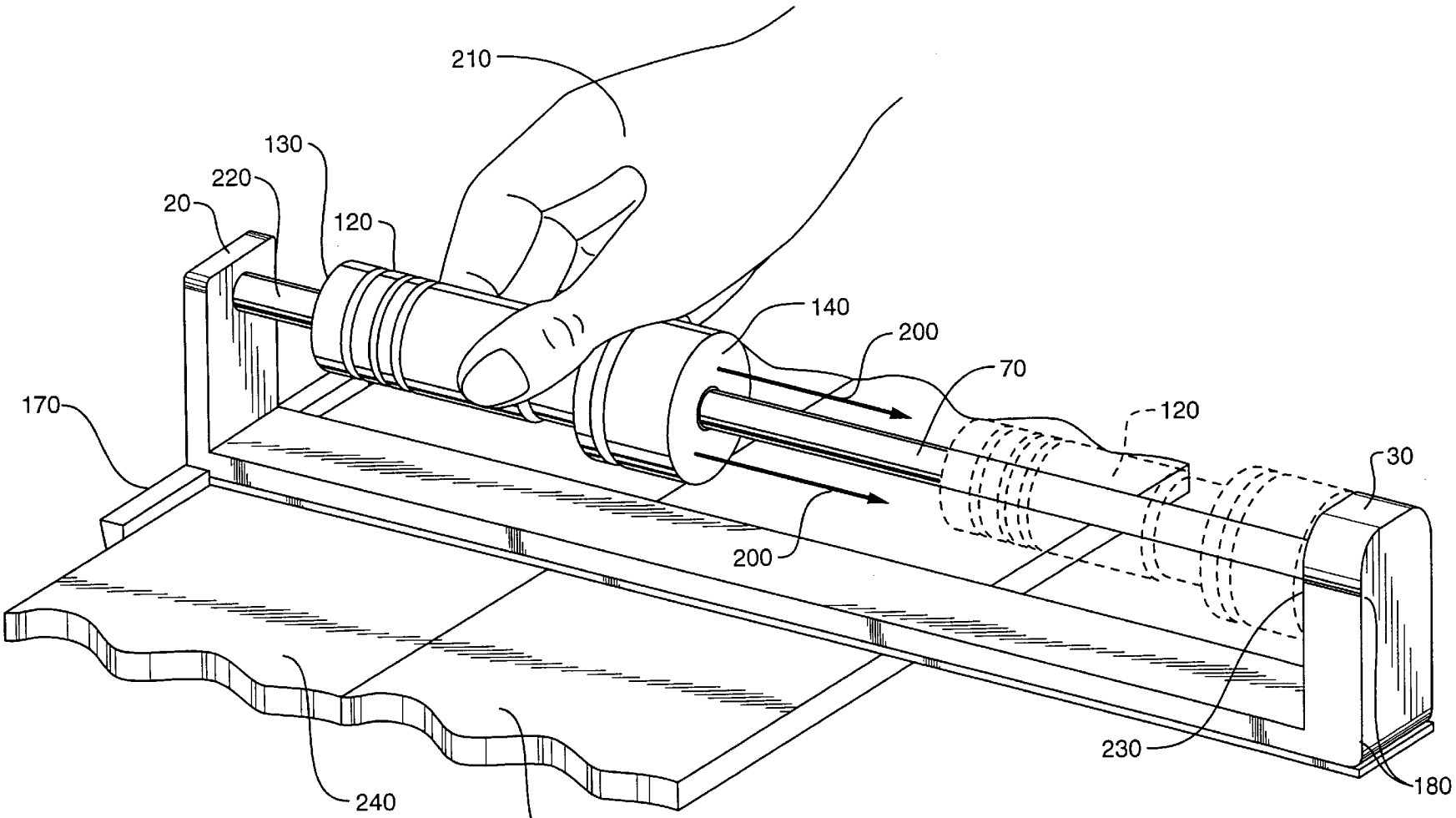
FIG. 2 illustrates use of the invention with the momentum building member beginning at a first vertical support member, sliding along the horizontal rod and impacting with a second vertical support member.

FIG. 2 illustrates the operation of the abutting device of the present invention. Momentum is built in the present invention by the operator 210 gripping the momentum building device 120 and sliding 200 it from the its starting position 220 with the front side 130 of the momentum building device 120 immediately adjacent said first vertical support member 20, the entire distance of the rod 70 until the back side 140 of the momentum building device 120 impacts said second vertical support member 30 shown as position 230. Momentum is then transmitted, due to the rigidity and continuous communication of the second vertical support member 30, the horizontal base member 40 and the lipped member 170, to the floor board 240; thereby forcing said floor board 240 against an adjacent floor board 250. It is appreciated that the wood flooring is merely one example of the use of the present invention. The present invention can be utilized to force any adjacent articles into a snugly abutting position.

Figure 3:
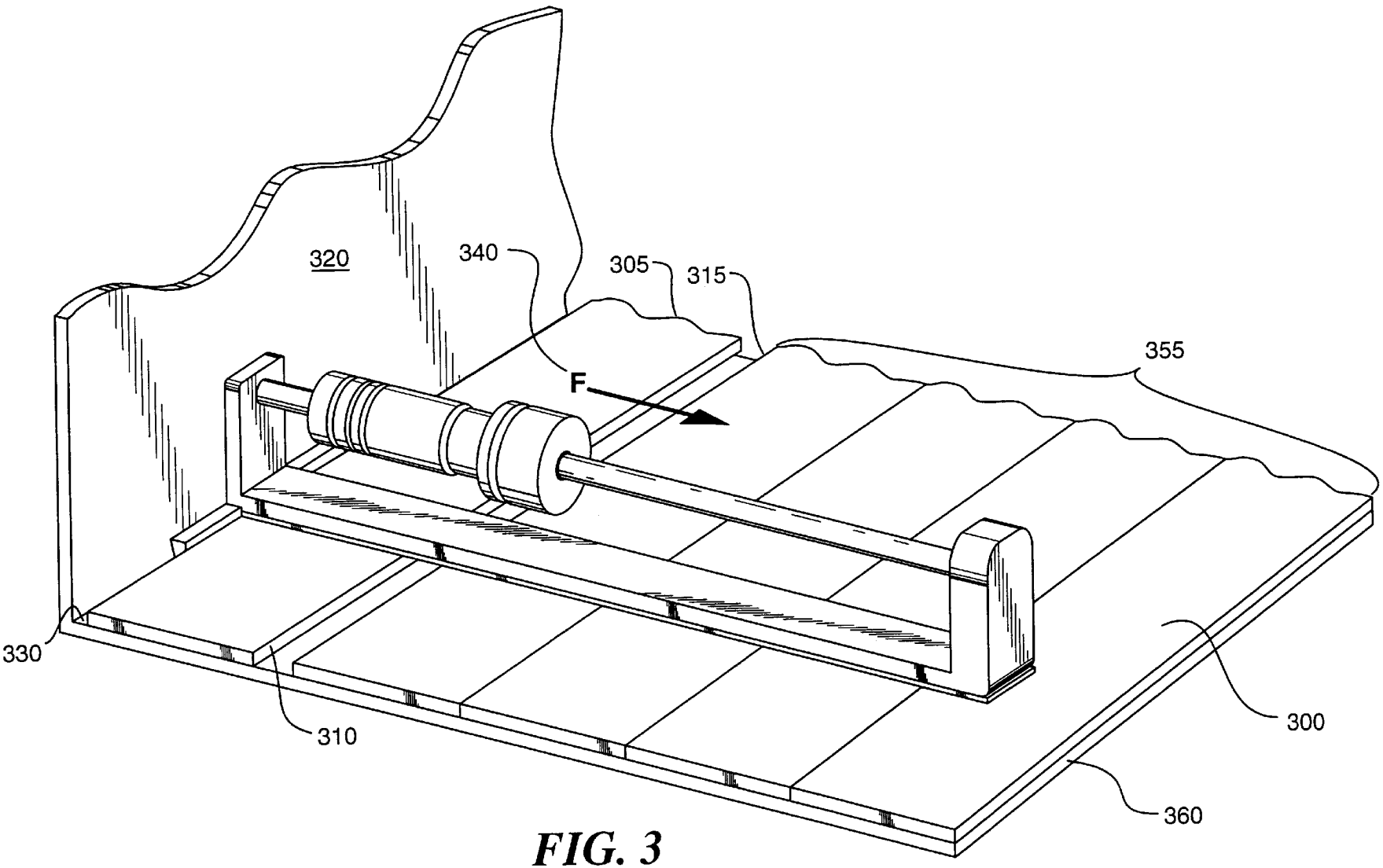
FIG. 3 depicts how the present invention can be used even when an obstruction such as a wall is immediately adjacent to the object upon which the force is to be exerted.

FIG. 3 depicts how the present invention can be used even when an obstruction such as a wall is immediately adjacent to the object upon which the force is to be exerted. When used in the laying of wood flooring as depicted generally as 300, many individual floor boards are abutted together 335 to completely cover the surface 360 upon which they are being laid. Providing the force 340 to abut these boards in a snug relation to each other is not difficult until the distance 330 between the board 305 and an obstruction such as a wall 320 is small. By varying the size of the lipped member 170 momentum can still be generated and force 340 can still be exerted to force the board immediate the obstruction 305 against its immediately adjacent floor board 315 even if the distance 330 is extremely small. Further, lipped member 170 can be tapered to allow for an even shorter distance 330 between the floor board 315 and obstruction 305.

It is claimed:

1. An abutting device, comprising:

a horizontal base member with a front side, a back side, a top side and a bottom side;

a lipped member rigidly communicated to said bottom side of said horizontal base member;

a first vertical support member with an interior side and an exterior side rigidly communicated to said front side and said top side of said horizontal base member;

a second vertical support member with an interior side and an exterior side rigidly communicated to said back side and said top side of said horizontal base member;

at least one horizontal rod member with a front side and a back side wherein said front side is connected via a connecting means to said interior side of said first vertical support member and said back side is connected via a connecting means to said interior side of said second vertical support member such that said horizontal rod member is substantially parallel to said horizontal base member; and a momentum building member slidably attached to said horizontal rod member between said first vertical support member and said second vertical support member such that there is sufficient distance between said first vertical support member and said second vertical support member to allow for said momentum building member to slide and build momentum when traversing from said first vertical support member to said second vertical support member and impacting thereon.

2. The abutting device of claim 1, wherein said connecting means on said interior side of said first vertical support member and said connecting means on said interior side of said second vertical support member is a cavity located therein which allows for said front side of said horizontal rod member to fit snugly within said cavity of said interior side of said first vertical support member and said back side of said horizontal rod member to fit snugly within said cavity of said interior cavity of said second vertical support member.

3. The abutting device of claim 1, wherein said lipped member is substantially parallel to said horizontal base member which allows for securing said horizontal base member to one of two articles which are to be abutted and for transferring longitudinal force.

4. The abutting device of claim 1, wherein said horizontal rod member is proportional in length to the amount of momentum which is desired to be created by said momentum building member.

5. The abutting device of claim 1, wherein said momentum building member is proportional in size to the amount of momentum which is desired to be created as it is slid across said horizontal rod member.

6. The abutting device of claim 1, wherein said horizontal rod member is cylindrical in shape.

7. The abutting device of claim 1, wherein said momentum building member is slidably attached to said horizontal rod member by said horizontal rod member passing through an opening throughout the length of said momentum building member.

8. The abutting device of claim 7, wherein said opening throughout the length of said momentum building member is cylindrical to allow said cylindrical horizontal rod member to pass therethrough.

9. The abutting device of claim 1, wherein said first vertical support member and said second vertical support member are substantially perpendicular to said horizontal base member and parallel to each other to allow for said horizontal rod member to be substantially parallel to said horizontal base member thus providing for the most efficient transfer of momentum from the second vertical support member to said lipped member and consequently to the article which is to be abutted.

10. A device for abutting wood floor boards which are adjacent an obstruction, comprising:

a horizontal base member with a front side, a back side, a top side and a bottom side which sets on a wood flooring which is to be abutted;

a lipped member rigidly and perpendicularly communicated to said bottom side and said front side of said horizontal base member which attaches to said floor board that is adjacent to an obstruction;

a first vertical support member with an interior side and an exterior side rigidly and perpendicularly communicated to said front side and said top side of said horizontal base member with a cavity on said interior;

a second vertical support member with an interior side and an exterior side rigidly communicated to said back side and said top side of said horizontal base member with a cylindrical cavity on said interior;

a cylindrical horizontal rod member with a front side and a back side wherein said front side is snugly fitted in said cylindrical cavity in said first vertical support member and said back side is snugly fitted into said cylindrical cavity in said second vertical support member;

a momentum building member slidably attached to said horizontal rod member between said first vertical support member and said second vertical support member such that there is sufficient distance between said first vertical support member and said second vertical support member to allow for said momentum building member to slide and build momentum when traversing from said first vertical support member to said second vertical support member and impacting thereon.

11. The abutting device of claim 10, wherein said lipped member is tapered to allow for insertion into narrow spaces.

12. A method for abutting floor boards which are adjacent obstructions comprising the steps of:

providing an abutting device which comprises a horizontal base member with a front side, a back side, a top side and a bottom side;

a lipped member rigidly communicated to said bottom side of said horizontal base member;

a first vertical support member with an interior side and an exterior side rigidly communicated to said front side and said top side of said horizontal base member;

a second vertical support member with an interior side and an exterior side rigidly communicated to said back side and said top side of said horizontal base member;

at least one horizontal rod member with a front side and a back side wherein said front side is connected via a connecting means to said interior side of said first vertical support member and said back side is connected via a connecting means to said interior side of said second vertical support member such that said horizontal rod member is substantially parallel to said horizontal base member;

a momentum building member slidably attached to said horizontal rod member between said first vertical support member and said second vertical support member such that there is sufficient distance between said first vertical support member and said second vertical support member to allow for said momentum building member to slide and build momentum when traversing from said first vertical support member to said second vertical support member and impacting thereon;

placing said lipped member of said abutting device against the side of a wood panel adjacent to said obstruction and opposite a wood panel to be abutted against; and placing said momentum building member immediately adjacent said first vertical support member and rapidly sliding said momentum building member along said horizontal rod member until said momentum building member impacts said second vertical support member thus transferring the momentum from said momentum building member to said second vertical support member and further to said horizontal base member thereby to said lipped member, thus forcing said wood panel adjacent an obstruction against said wood panel it is abutted against.

* * * * *